US008925922B2

(12) United States Patent
Nwanna

(10) Patent No.: US 8,925,922 B2
(45) Date of Patent: Jan. 6, 2015

(54) GAME

(76) Inventor: Dozie Nwanna, London (GB)

( * ) Notice: Subject to any disclaimer, the term of this patent is extended or adjusted under 35 U.S.C. 154(b) by 733 days.

(21) Appl. No.: 12/995,513

(22) PCT Filed: Jun. 2, 2009

(86) PCT No.: PCT/GB2009/050607
§ 371 (c)(1),
(2), (4) Date: Feb. 21, 2011

(87) PCT Pub. No.: WO2009/147429
PCT Pub. Date: Dec. 10, 2009

(65) Prior Publication Data

US 2011/0180989 A1 Jul. 28, 2011

(30) Foreign Application Priority Data

Jun. 2, 2008 (GB) ..... 0810027.3

(51) Int. Cl.
*A63F 7/06* (2006.01)
*A63F 9/00* (2006.01)
*A63F 7/34* (2006.01)

(52) U.S. Cl.
CPC ..... *A63F 7/06* (2013.01); *A63F 7/0616* (2013.01); *A63F 2007/346* (2013.01); *A63F 7/0668* (2013.01); *A63F 2007/345* (2013.01)
USPC ..... 273/108.1; 273/127 R; 273/148 R; 273/317; 273/348; 273/407

(58) Field of Classification Search
CPC ... A63F 7/06; A63F 7/0616; A63F 2007/345; A63F 2007/346; A63F 2/0668; A63F 7/20; A63F 7/22; A63F 9/0204; A63B 63/00
USPC ..... 273/317–317.9, 354, 348, 331, 148 R, 273/108, 108.1, 108.4, 404, 407, 408, 410, 273/394, 398, 288, 289, 127 R, 401; 473/454, 444, 438, 446, 411; 446/268
See application file for complete search history.

(56) References Cited

U.S. PATENT DOCUMENTS

| | | | | | |
|---|---|---|---|---|---|
| 811,963 | A | * | 2/1906 | Shaules | 273/317.6 |
| 1,248,639 | A | * | 12/1917 | Fay | 273/389 |
| 1,348,860 | A | * | 8/1920 | Friend | 273/383 |
| 1,395,545 | A | * | 11/1921 | Aley | 273/382 |
| 1,418,339 | A | * | 6/1922 | Templeton | 273/381 |
| 2,801,854 | A | * | 8/1957 | Trudeau | 473/411 |
| 3,091,459 | A | * | 5/1963 | Lindman | 273/108.4 |
| 3,856,298 | A | * | 12/1974 | Frantti | 473/446 |
| 3,913,916 | A | * | 10/1975 | Martin, Jr. | 473/479 |
| 3,945,640 | A | * | 3/1976 | Denmark | 273/288 |
| 4,334,682 | A | * | 6/1982 | Ham | 273/317.3 |
| 4,408,761 | A | * | 10/1983 | McAllister | 273/108.5 |
| 5,333,865 | A | * | 8/1994 | Holmes | 273/317.5 |

(Continued)

*Primary Examiner* — Sebastiano Passaniti
(74) *Attorney, Agent, or Firm* — Heslin Rothenberg Farley & Mesiti P.C.

(57) ABSTRACT

An apparatus for playing a game and particularly a table-top game which represents soccer. The apparatus includes a figure for playing a game comprising a model player fitted to a hollow base (5) wherein the base has at least one opening (2, 3, 4) in communication with the cavity and the player has at least one opening (1) in communication with the cavity, and wherein a ball can enter the cavity through the opening on the base or the opening on the player.

15 Claims, 14 Drawing Sheets

(56) References Cited

U.S. PATENT DOCUMENTS 6,458,048 B1 * 10/2002 McGrath ..... 473/421
7,448,968 B1 * 11/2008 Petion ..... 473/446
8,413,990 B2 * 4/2013 Allshouse et al. ..... 273/371

* cited by examiner

GAME

CROSS REFERENCE TO RELATED APPLICATIONS

This application is a U.S. National Phase filing under 35 U.S.C. §371 of International Application PCT/GB2009/050607, filed Jun. 2, 2009, and published as WO 2009/147429 on Dec. 10, 2009. PCT/GB2009/050607 claimed benefit of priority from Great Britain Patent Application No. GB 0810027.3 filed Jun. 2, 2008. The entire contents of each of the prior applications are incorporated herein by reference.

BACKGROUND OF THE INVENTION

This invention relates to an apparatus for playing a game, and particularly to a table-top game which represents soccer. The game is to be known as R.O.S.A, which stands for "The Rose of South Africa".

Soccer (or football) is one of the world's most popular sports. According to a recent survey 265 000 000 players and 5 000 000 referees and officials are actively involved in the game (www.fifa.com). In addition, perhaps even greater numbers participate as spectators.

Furthermore, interest in football is not confined to the conventional version of the sport. Simulated versions of football are also very popular. For example football computer games are well known and sell in extremely large numbers (for example Championship Manager™ and FIFA Football™) and table-top games (for example Subbuteo™) have been popular for many years.

There is, therefore, clearly a large and enduring worldwide interest in football and simulated versions thereof, and consequently a market exists for new variations and simulations of the game.

BRIEF SUMMARY OF THE INVENTION

The present invention is directed towards the following goals:

to provide a new adaptation of soccer for playing on a table;

to provide a means whereby persons who are merely able to apply a cue on a ball can enjoy the full passions of soccer;

to represent soccer as a new type of table game to be characterised by stand-alone playing-figures, rather than the bundles and packs of linked-up multiples playing-figures used in the more mechanical representations;

to provide a means of representing table soccer that is characterised by independent deliberate playing actions, as opposed to the unskilled twiddling, perfunctory badgering, or random spinning, characteristic of some other representations;

to provide a means of representing table soccer to be characterised by gentle, individual, precise actions undertaken piecemeal, as opposed to the enervating and off-putting tussling and scurrying characteristic of other representations;

to provide a means of playing table soccer that accentuates tactical and strategic inputs of the individual player, which are usually relegated, obscured or totally omitted, in other representations of soccer;

to provide a fresh means of widening the culture of soccer and furthering the game's overall appreciation and understanding among peoples without discrimination due to age, gender or physical condition;

to provide a means of promoting appreciation of ball dynamics in the broad spectrum of soccer;

to provide a means of promoting the sense of tactics in the broad spectrum of soccer;

to provide a means of promoting the sense of strategy in the broad spectrum of soccer;

to provide a means of developing and disseminating acquisition strategies in the broad spectrum of soccer;

to provide a means of conducting analysis in the broad spectrum of soccer;

to provide a means of developing and promoting analytical approaches to the study in the broad spectrum of soccer;

to provide a means of developing and promoting strategies for analysing player movement in the broad spectrum of soccer;

to provide a means of developing and promoting strategies for analysing ball movement in the broad spectrum of soccer;

to provide a means of developing and promoting strategies for prognostication on the evolution of the broad spectrum of soccer;

to provide an alluring, safe and affordable, playing device of accessible technology;

to provide a playing device for exploiting the universal attractions of soccer for social purposes;

to provide a playing device for opening up the fun of soccer playing to special sections of the populace usually omitted, put-off or otherwise excluded, from the sport by the stringent physical requirements and/or qualifications required for actual soccer;

to provide a playing device for enjoying and sharing the passion of soccer playing, which is normally only an illusion for the teeming billions of soccer fans relegated to mere spectatorship at their favourite sport by personal conditions (such as age, health, gender, etc.) that have been basis of discrimination and inadmissibility from actual participation;

to provide a playing device for exercising mind as well as the body, particularly the muscles of the eyes and limbs;

to provide a playing device for developing mental coordination;

to provide a playing device for the development of psychomotor coordination;

to provide a playing device for improving or remedying concentration;

to provide a playing device for contributing to the remedying of attention deficit disorders;

to provide a playing device for contributing to the remedying of hyper-activity disorders; and to provide a playing device for contributing to the remedying of depression and low self-esteem.

Accordingly the present invention provides a game for playing a simulated version of football (or soccer).

In a first aspect the invention provides a figure for playing a game comprising a model player fitted to a hollow base defining a cavity wherein the base has at least one opening in communication with the cavity and the player has at least one opening in communication with the cavity, and wherein a ball can enter the cavity through the opening on the base or the opening on the player.

In a second aspect the invention provides a team comprising from one to ten figures described above and a moveable barrier attached to a handle.

In a third aspect, the invention provides a game comprising:

a plurality of figures according to claim 1;

at least one ball; a playing surface having two sides and two ends; two goals; and at least two cues.

BRIEF DESCRIPTION OF THE DRAWINGS

The present invention will now be described with reference to the accompanying drawings, in which.

DETAILED DESCRIPTION OF THE INVENTION

As mentioned above, the first aspect of the invention provides a figure comprising a player which is mounted on a base, wherein the base encloses a cavity. That is the base is at least partially hollow. The hollow interior or cavity is accessible via at least one opening on the base and furthermore via at least one opening on the player.

The openings may be formed in any manner, as long as they provide a route or means of access to the cavity.

Preferably there is provided one, two or three openings on the player, and more preferably the figure has only one opening on the player. Most preferably the player has a chest and the opening on the player is on the chest.

Preferably there is provided one, two or three openings on the base. Particularly preferably the figure has three openings on the base.

Particularly preferably the figure has one opening on the player and three openings on the base.

The openings on the base can be located in any position on the base. Preferably, there are three openings on the base, and the three openings are positioned at the left, right and front of the base respectively, wherein left, right and front refer to the positions from the perspective of the player.

As discussed above, the player is attached to a base. The base may take any form as long as it is capable of supporting the player in an upright position on a flat surface. Preferably the player is releasably attachable to the base.

As mentioned above, the openings may be formed in any manner, as long as they provide a route or means of access to the cavity. In relation to the openings on the base, the or each opening on the base may be an aperture or hole on the base. Alternatively, for example, the or each opening on the base may be via an arch formed in the base.

A preferred embodiment of the figure, wherein the cavity has one entrance which is via an opening on the chest and three entrances which are arches formed in the base is illustrated by FIGS. 1 to 12.

Figure 1:
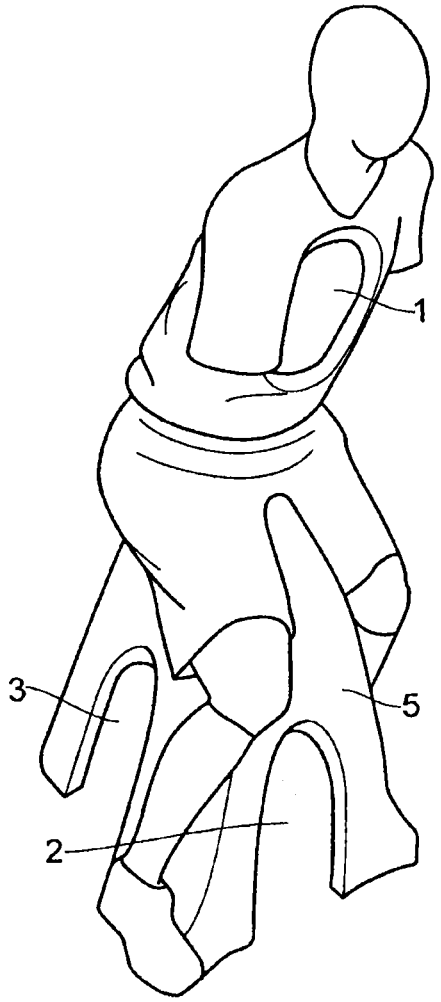
FIGS. 1-6 show a figure according to the invention.
Figure 2:
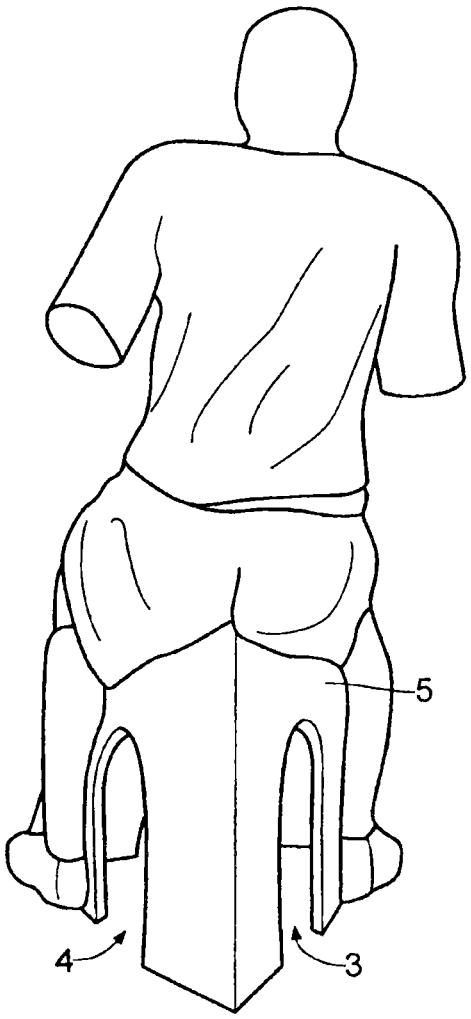

FIG. 1 shows a figure according to the invention, having an aperture 1 in the chest region. The base of the player is formed in three arches which provide openings 2, 3, 4 (only two of the openings are visible in FIG. 1) to the cavity enclosed within the base. FIG. 2 shows a diagram of the same player as viewed from the rear.

The base 5 must be suitable to be able to support the player on a flat surface. In order to provide increased stability, the base may be magnetic, comprise a suction cup, a Velcro mechanism, or any other adhesive means that would cause the player to be attracted to an appropriate complementary surface.

Figure 3:
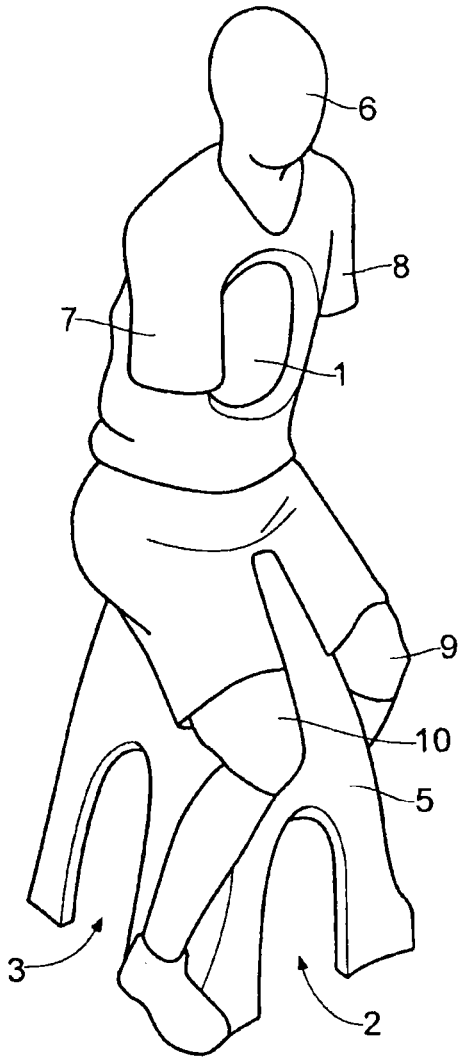
Figure 4:
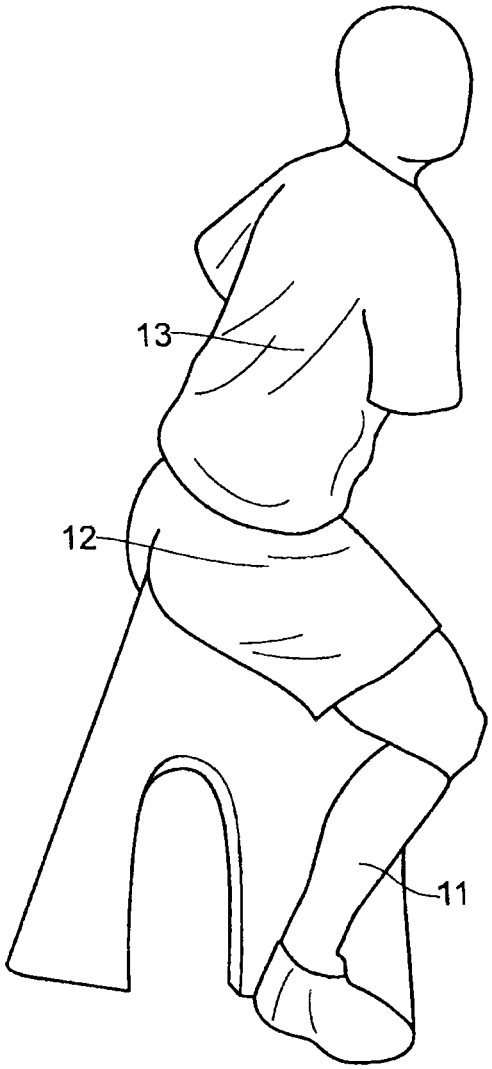

It can be seen that the player is adapted to resemble a human and therefore preferably also comprises a head 6, arms 7, 8 and legs 9, 10 (FIG. 3). The appearance of the player in terms of shape, form or size can be adapted as desired. For example, the player may take any appearance, cast, race, body, build, posture, proportions, and effigy. Particularly preferably, the players are adapted to resemble players of known national and club football teams in terms of appearance, especially in terms of facial appearance, hair and skin tone, and in terms of the kit in which the player is dressed: socks 11, shorts 12 and shirt 13 (see FIG. 4).

In one embodiment the invention provides kits including ten figures as described above, wherein each player is identical.

As discussed, the cavity within the base is accessible via opening 1 in the chest region and openings 2, 3, 4 in the base region. This can clearly be seen from FIGS. 5 and 6.

In order to allow access to the cavity via the aperture in the chest of the player a passage through the player between the opening and the base must be provided. This requires that the player is partially hollow and the base and the player must also have aligned openings at their mutual point of contact. The opening on the base is labelled 14 (FIG. 5).

Figure 6:
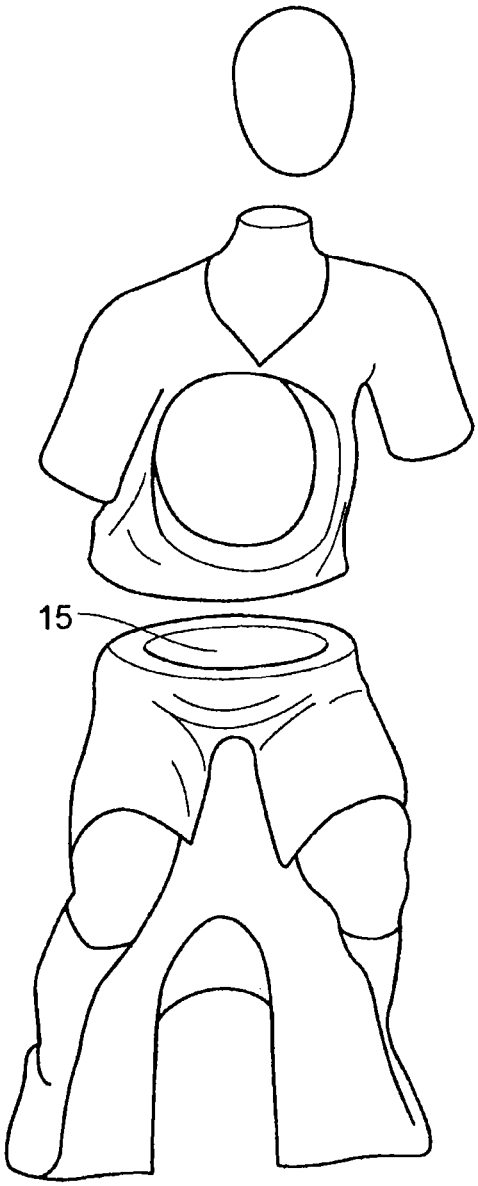

FIG. 6 is an exploded diagram of the player. The partially hollow interior 15 of the player can be seen which provides the route from the opening in the chest 1 to the cavity via the opening in the base 14.

Figure 5:
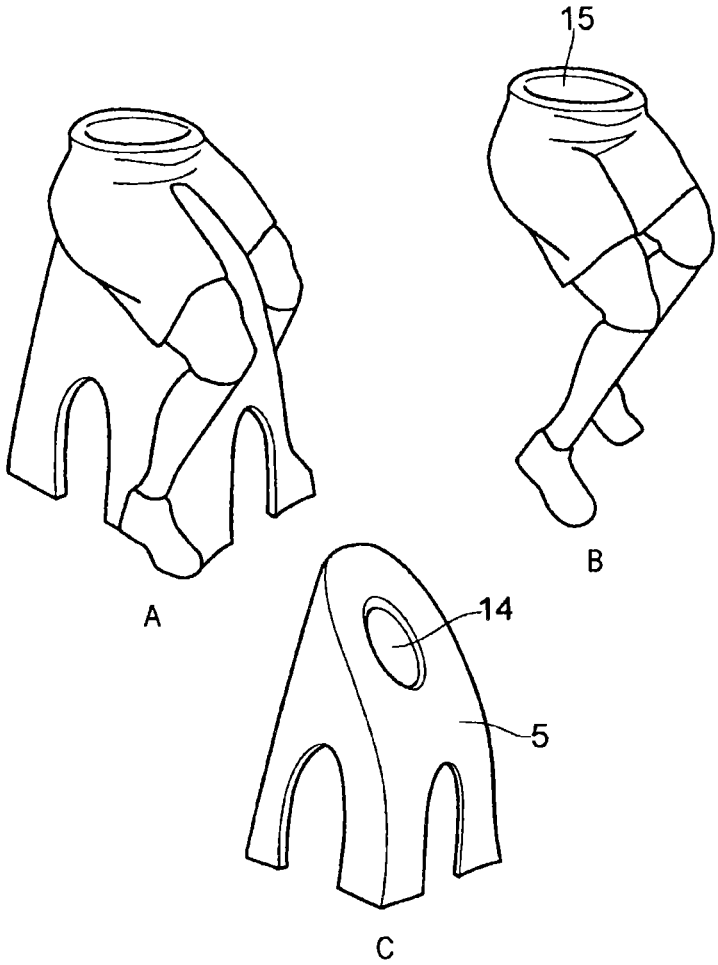

FIG. 5 also illustrates that the player may be separable from the supporting base. Any appropriate clip or fastening device may be used to attach the player to the base.

The player according to the invention may be made of any suitable material, for example plastics or wood.

Particularly preferably, a team comprising ten players as described hereinabove is provided.

In addition, the present invention provides a ball. The ball may be made of any suitable material, for example plastics. Preferably the ball resembles a conventional football, albeit being a smaller size. Of course, the ball is preferably substantially spherical.

The ball has appropriate dimensions to enter the cavity enclosed within the base of each player of the team via the opening on the player and the opening on the base. That is the ball is proportioned so as to permit the ball, when sufficiently and accurately propelled, to enter the or each opening on the base and the or each opening on the player so as to enter the cavity.

After the ball has passed though one of the openings, it may come to rest within the cavity of the player. Alternatively, the ball may exit again via the or a different opening in the base if for example it enters at an inappropriate angle or speed.

When the ball enters the opening on the player, due to the action of gravity it will descend through the interior of the player to the cavity in the base, where it may remain within the base or exit via an opening on the base of the player. In order to allow this, a route must be available from the opening on the player, through the player itself, to the cavity enclosed in the base, wherein the route, throughout its entire length, is sufficiently proportioned to accommodate the ball.

In a further aspect the invention provides a plurality of cues, each cue being adapted to strike the ball and thereby alter the position of the ball. The cues are shaped like those commonly used in snooker, billiards and pool. They may, of course be of varying length, girths and weights so as to be appropriate for the size and strength of a given user.

The invention also provides studs for supporting the ball in an elevated position above the surface upon which the stud is positioned. The studs perform similar role to tees in golf—that is the stud has a base which provides a stable alignment of the stud and the surface upon which it is positioned and the stud also has means to support the ball above the surface.

When the ball is placed on the stud it allows a user of the game to loft the ball when striking it with the cue. That is it makes it easier for a user to hit the ball into the air with the cue rather than merely along the ground. In particular, this allows the user to aim the ball towards an opening situated on a player, particularly preferably wherein the opening is on the chest of the player.

The invention also provides a playing surface suitable upon which to play the game according to the invention. The playing surface comprises a rectangular surface having sides and two ends, and is preferably adapted to resemble a conventional football pitch.

Figure 7:
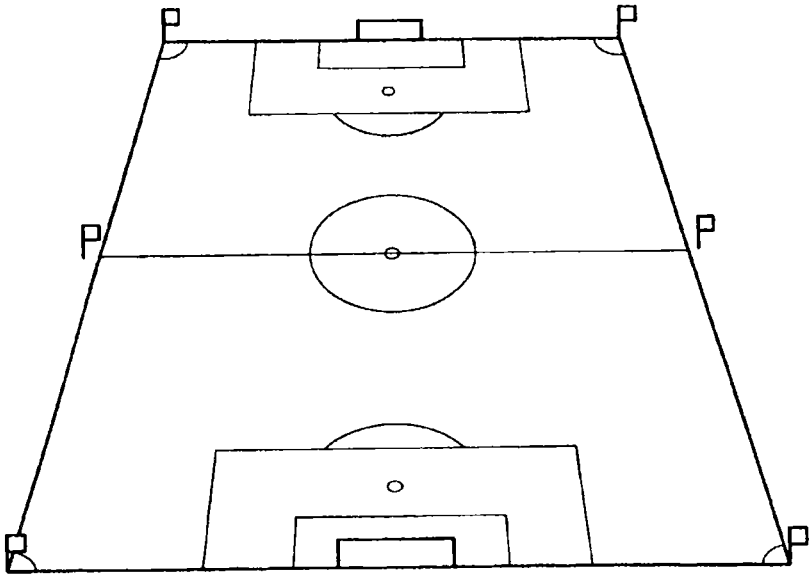
FIGS. 7-8 show a playing surface according to the invention.

FIG. 7 shows a playing surface according to the invention. The playing surface may be made of any suitable material, for example fabric, plastics or wood.

The football pitch for use in the full-scale version of the game has dimensions defined by Law 1 of The Laws of the Game: (http://www.fifa.com/mm/document/affederation/federation/laws_of_the_game__0708__10565.pdf).

Preferably the playing surface according to the invention is designed to resemble a conventional football pitch, and therefore the relative dimensions of the playing surface, for example the ratio of the length of the pitch to the width of the pitch, are the same as those described in The Laws of the Game. However, the playing surface according to the invention is of course on a smaller scale.

Particularly preferably, and as illustrated by FIG. 7, the playing surface is marked with lines in the same manner as a conventional football pitch: that is the playing surface has two goal lines, two touch lines, two penalty areas, two goal areas, two penalty marks and two penalty arcs as well as a halfway line, a centre circle and a centre mark. In each corner where the touchlines meet the goal lines, preferably corner arcs are marked and corner flags are positioned.

Figure 8:
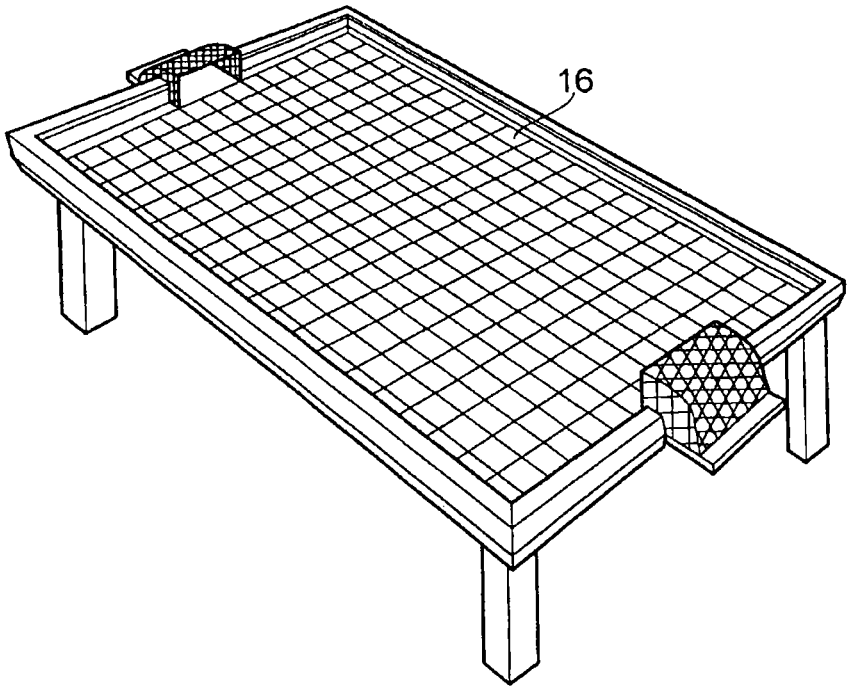

Preferably in addition to bearing the conventional marks of a football pitch, the playing surface is demarcated into a number of squares 16 (FIG. 8). Each square is of equal dimensions, and is of an appropriate size to accommodate the base of the figure according to the invention.

The squares may be distinguished from each other by any means. Particular methods that may be mentioned are by varying the colour of each square from those each other squares with which the each square shares a side, for example in the manner of a chess board. Alternatively, the squares may be distinguished by reticulation when the playing surface is of only one colour. The lines which reticulate the playing surface must be distinguishable from the above described pitch markings.

Particularly preferably, the playing surface is demarcated in 300 squares of equal size, which squares are arranged in a grid of 15 (along the length of the minor side of the playing surface) by 20 (along the length of the major side of the playing surface).

In one embodiment the playing surface is at least partially surrounded by a trough. That is, the circumference of the playing surface is surrounded by means to catch a ball which leaves the side of the playing surface. Preferably the playing surface is completely surrounded by an endless trough.

Figure 9:
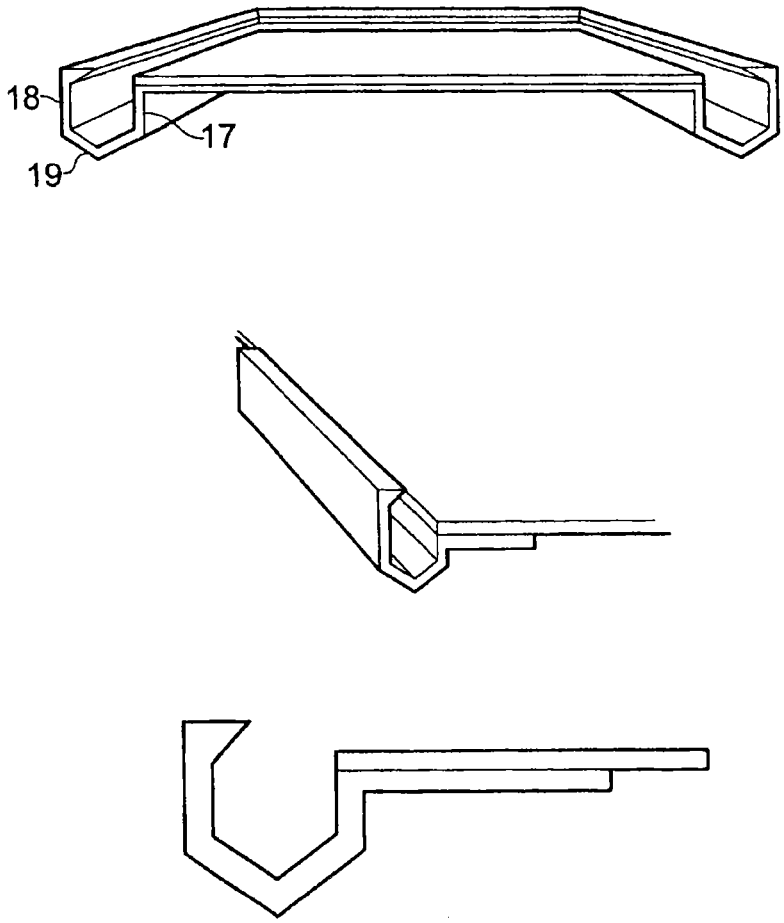
FIGS. 9-10 show a trough according to the invention.

One embodiment of the trough is illustrated by FIG. 9. The trough in FIG. 9 has an inner rim 17 attached to the edge of, and perpendicular to, the playing surface, and an outer rim 18 spaced away from, and perpendicular to, the playing surface, wherein the inner rim and outer rim are connected towards their lower edges by a bottom surface 19 which is displaced laterally downwards from the playing surface. The purpose of the trough is to catch balls which leave the playing surface, which would otherwise roll onto the floor.

Figure 10:
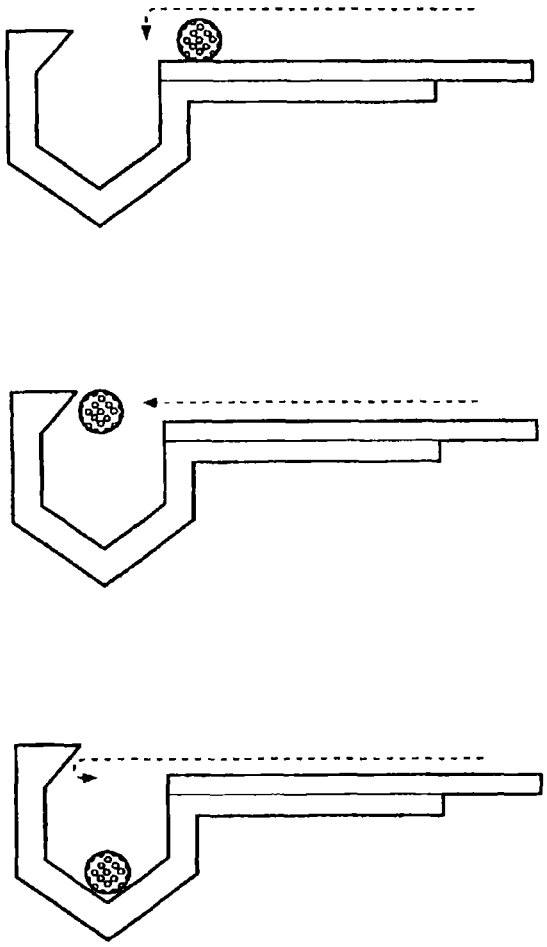

Particularly preferably the upper part of the outer rim of the trough extends above the level of the playing surface, thereby increasing the chance of the trough catching balls which leave the playing surface at higher speeds. Further, the outer rim 18 of the trough broadens towards its upper edge so to be inclined at an angle towards the playing surface, thereby increasing the chance of a ball hitting this region of the outer rim being deflected into the trough. FIG. 10 illustrates a ball leaving the playing surface and being collected in one embodiment of the trough according to the invention.

Figure 11:
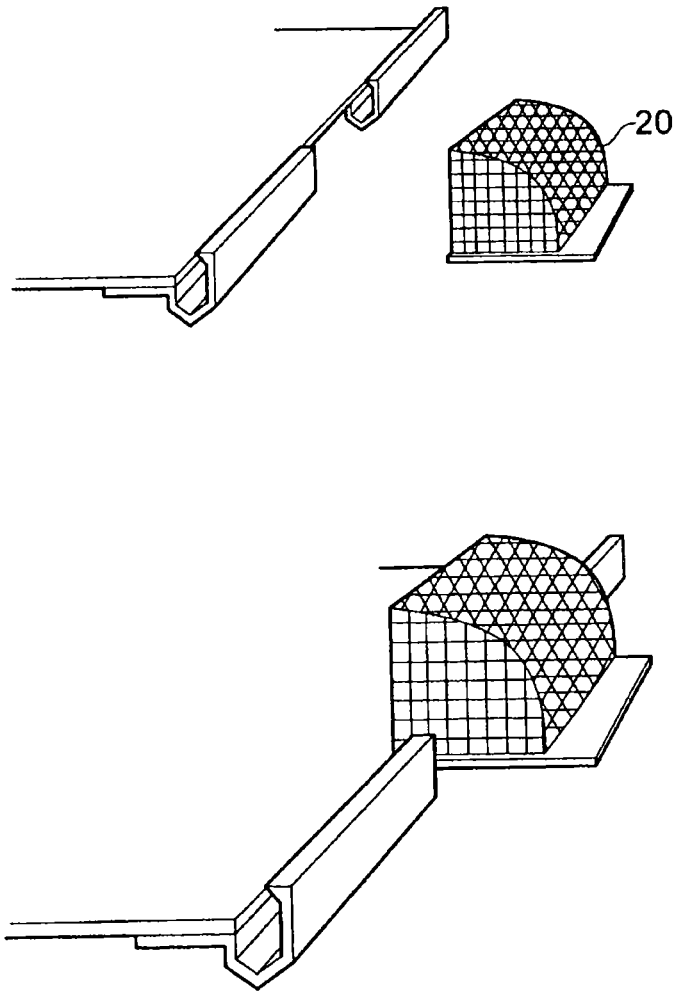
FIG. 11 shows a goal according to the invention.

The invention further provides a first goal and a second goal. As can be seen in FIG. 11, the goals 20 are designed, as in conventional football, to be positioned at the end of the playing surface on the goal lines.

Preferably each goal is releasably attachable to the middle of each of the goal lines of the playing surface as can be seen by the embodiment illustrated by FIG. 11, and thereby the goal may be separated from the playing surface when the game is not in use and attached to the playing surface when the goal is in use.

Each goal comprises two posts joined at their upper limits by a cross bar. Particularly preferably the posts and cross bar are attached to a net wherein the net is positioned to catch a ball which passes from the playing surface between the posts and the crossbar over the goal line.

Preferably the goal resembles the goal as used in conventional football, albeit of course on a reduced scale.

The posts and cross bar of the goal can be made of any suitable material. Preferably the material is plastics or metal.

In another aspect the invention provides a moveable barrier attached to a handle. The barrier is the game's equivalent to the goal keeper.

Preferably, the barrier may be manipulated by a user positioned behind the goal with the handle.

Figure 12:
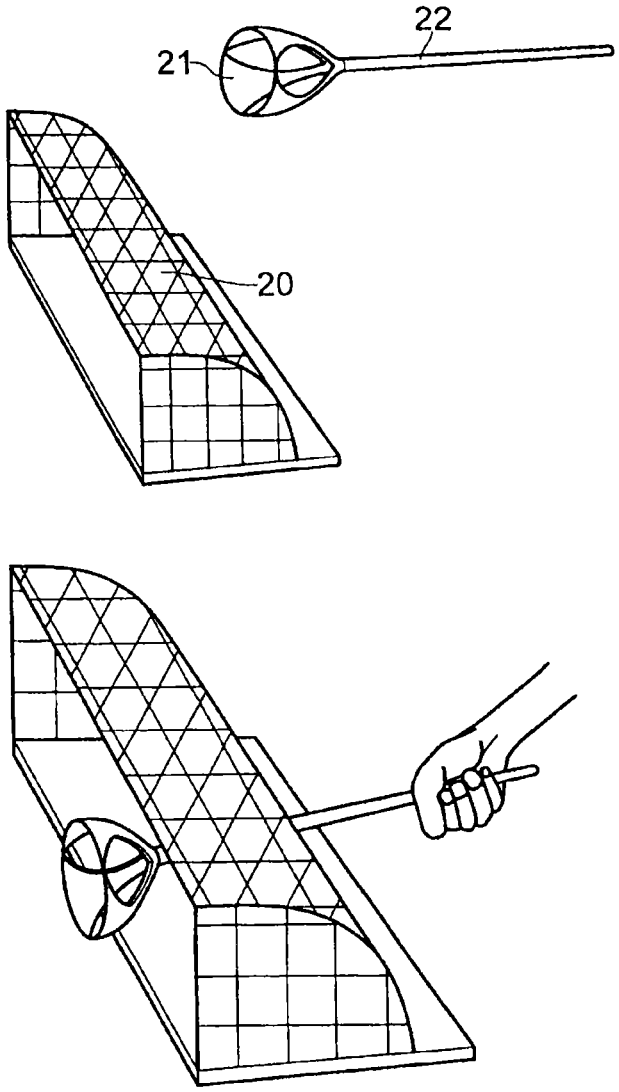
FIG. 12 shows a goal and a barrier according to the invention.

One embodiment of the barrier 21 is illustrated by FIG. 12 and has a handle portion 22, wherein the handle may be positioned to extend behind the goal and may be used to manipulate the position of the barrier.

The invention also provides kits comprising one or more of the aspects of the invention described above.

In one preferred embodiment the invention provides a team comprising from one to ten players and a moveable barrier attached to a handle, and more preferably the invention provides a team comprising ten players.

The present invention also provides apparatus suitable for playing a game substantially as described herein.

Particularly preferably the invention provides apparatus substantially as described in the description and illustrated in the figures.

Most preferably, the invention provides a game comprising:

a plurality of figures according to claim 1;
at least one ball;
a playing surface having two sides and two ends;
two goals; and
at least two cues.

Figure 15:
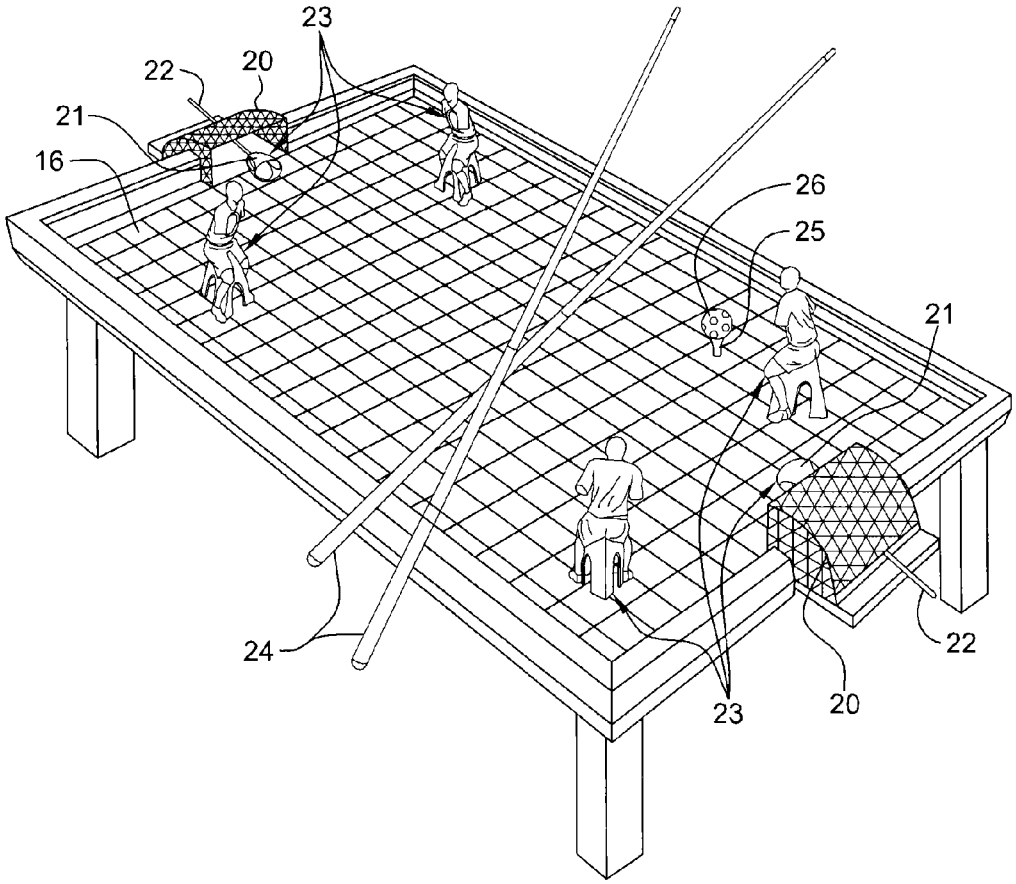
FIG. 15 shows a game according to the invention.

FIG. 15 illustrates one embodiment of a game according to the invention. Shown is a playing surface demarcated with squares 16 and goals 20. In this figure, two teams 23 are shown that include two players and a moveable barrier 21 attached to a handle 22 each. Two cues 24 are shown. Also shown is a stud 25 that may be used for supporting a ball 26.

Example

As mentioned above, the present invention relates to apparatus for playing a table-top game which simulates soccer. In a preferred embodiment the above-defined apparatus is used in a game as described by the following rules. However, it should be noted that the following rules are not limiting in any way and are only used to illustrate one use of the apparatus as described above.

Rules of the Rose of South Africa (Rosa)

Introduction

1. "the Beautiful Game" on Table

Rosa is a kind of Table Soccer played with a cue. The game aims to capture as much as possible the many unique features that have made soccer the most popular sport of this age. In Rosa, a ball on a pitch is shot with a cue (or flicked with a finger), with the objective of scoring goals, i.e. setting the ball across the goal line of the opponent. Rosa involves two competing teams and the total goals scored by the teams decide the game. The winner is the team that scored more number of goals.

Equipment

2. Pitch, Ball, Equipment

The game described in these rules is designed for pitchs, balls and equipment meeting the standards prescribed in the Rosa Association Equipment Specifications.

3. Goalie-Boom:

The goalie-boom is a special handle-device for the defence of the goal, whereby it could be used for picking up goal-bound balls before they cross the goal line, i.e. between the posts.

4. Player (a) This is the figure representing the human player on the pitch.

(b) Ten PLAYERS plus one goalie-boom constitutes a team.

(c) PLAYERS of the same team are referred to as MATES.

(d) A PLAYER may be transferred from one square to another as well as be turned to face a new direction in the course of play, but never to encroach the SQUARE of another.

5. Poser

The poser of any team is its PLAYER positioned nearest to the ball, especially one that is not in control of the ball.

6. Attacker

This is the PLAYER directly in control of the ball. In consequence, the team to which an attacker belongs is referred to as the ATTACKING TEAM.

7. Patch (of a Player)

Figure 13:
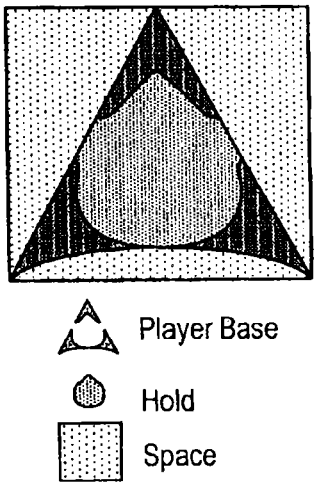
FIG. 13 shows a square of a player.

(a) This is the portion of the pitch immediately occupied by a PLAYER, usually one of the 300 squares into which the pitch is demarcated. (See FIG. 13).

8. Range (of a Player)

Figure 14:
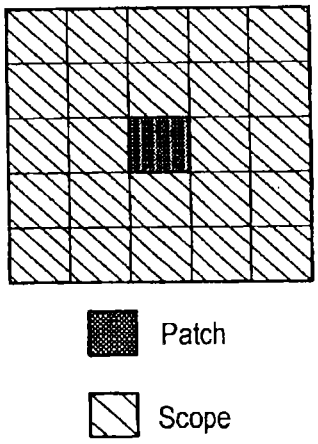
FIG. 14 shows the range of a player.

This refers to all the PATCHES a PLAYER can conduct COVERING to from one point (FIG. 14).

Operations

9. Placement (a) This refers to a PLAYER being on a PATCH.

(b) Placement shall as much as possible be within or at the middle of a PATCH (c) Placement shall only be undertaken in a manner that does not encumber any earlier-placed PLAYER.

10. Bearing (a) This is the direction in which the FRONT of a PLAYER faces.

(b) A PLAYER may face any direction.

11. Rotation (a) This is the turning round of a PLAYER to change its bearing.

(b) A rotation may only be executed in place of COVER or as part of a COVER or DRIBBLING.

12. Covering (a) This is the optional relocation of a PLAYER by one or two strides in any direction, or lifting and then dropping it in the same PATCH.

(b) There are three types of covering, namely:

(i) Prelusive Cover (PC): a setting-off covering undertaken with a PLAYER other than the attacker, before the shot is taken by the ATTACKER.

(ii) Independent COVER (IC): the pre-emptive covering undertaken by the DEFENDING TEAM before the ATTACKING TEAM takes its shot.

(iii) Counter-Cover (CC): a defensive covering undertaken immediately after an earlier covering by the opponent.

(c) An ATTACKER may only undertake COVERING alone, i.e. without the ball.

(d) Only one COVERING may be undertaken by same player at a time.

13. Shooting (a) A player, using a cue, takes shots on behalf of the PLAYERS of a team.

(b) If a shot is to be taken, the affected ATTACKER is temporarily set aside to make space, and a (coin-like) token substituted on its PATCH as a marker, before a PLAYER actually executes the shot.

(c) After a shot has been taken, the responsible PLAYER is immediately returned to the PATCH it had been cleared from, and the token that had been substituted for it removed.

(d) Legal shots require that the ball be shot only with the cue tip.

(e) A player must cause the ball to roll or soar by a fair shot, not by pushing.

(f) A shot at the goal can be taken from any point on the pitch.

(g) A player need not wait for the goalkeeper to be ready before shooting.

14. Soaring (a) In shooting, the cue may be applied in a manner that digs under or lofts the ball so that it rises off the pitch, irrespective of whether it soars over any MATE or OPPOSITION.

(b) It is legal to use a STUD to effect soaring of the ball, but studs must conform to approved specifications.

15. In Ball (a) This is a situation where, after a legal shot, the ball comes to rest in the HOLD of a PLAYER.

(b) At the event of an IN BALL, the ATTACKING TEAM and the DEFENDING TEAM are entitled to one PRELUSIVE COVER and COUNTER-COVER (IC), respectively.

(c) The ATTACKER'S shot shall not be taken until the DEFENDING TEAM has exercised or given up its right to the IC.

16. Close Ball (a) This is a situation where, after a legal shot, the ball comes to rest within the PATCH of the PLAYER but lies outside the HOLD.

(b) In the event of a CLOSE BALL, the two teams are entitled to one cover each, with the DEFENDING TEAM having the first choice, after which the PLAYER closest to the ball becomes, or continues to be, the ATTACKER. The attacker's shot shall then follow.

17. Far Ball (a) This is a situation where the ball comes to rest outside the PATCH of the PLAYER but remains within the RANGE of the PLAYER.

(b) In the event of a FAR BALL, the two teams are entitled to one cover each, with the DEFENDING TEAM having the first choice, after which the PLAYER closest to the ball becomes, or continues to be, the ATTACKER. The attacker's shot shall then follow.

18. Control & Loss of Control (of Ball)

(a) A team is said to be in control if, after its shot, the ball comes to rest in the HOLD of any one of its PLAYERS.

(b) A team is said to have "lost control" if the ball shot by it, while still on the pitch, is not in the HOLD of any of its PLAYERS.

(c) Once the ball comes to rest, it is the responsibility of the team that made the shot to proclaim the STATE OF CONTROL by audibly declaring: "IN", "CLOSE", OR "FAR", according to the location of the ball.

(d) It is the responsibility of the team that shot the ball last to proclaim the loss of control (if it happens, by audibly declaring: "ouT."

(e) A declaration of the STATE OF CONTROL becomes incontestable after three seconds.

(f) The game becomes uninterruptible if, three seconds after a declaration there was no protestation by the opponent.

(g) The game shall not proceed if any declaration is being contested.

(h) A team's turn of play continues while it retains control and is relinquished to the opponent in consequence of a loss of control.

(i) Once CONTROL OF BALL is established the team in control shall:

(i) Directly SHOOT the ball;

(ii) Dribble and then shoot the ball; or, (iii) Undertake a PRELUSIVE COVER (PC), and then shoot the ball.

19. Dribbling (a) This is an incidental relocation of an ATTACKER, together with the ball in its HOLD, to a maximum destination of 10 strides.

(b) Dribbling may only be conducted in a horizontal, vertical, or combination of horizontal and vertical directions.

(c) A PLAYER may undertake dribble only once while it is the ATTACKER.

(d) At the event of dribbling, the DEFENDING TEAM is entitled to one INDEPENDENT COVER (IC), once after each change of direction by the dribbler.

(e) The attacker may take its shot at any point during the dribbling, provided the DEFENDING TEAM gets a chance to exercise or reject its right to an IC.

(f) If the DEFENDING TEAM executes an IC, the ATTACKING TEAM is entitled to one COUNTER-COVER (CC).

(g) Once a CC is conducted, the attacker must immediately proceed with its shot irrespective of whether or not the entitlement of 10 strides for dribbling has been used up.

20. Free Ball (a) A ball is said to be FREE if, when it comes to rest, it is lying beyond the RANGE of the nearest PLAYER while still being on the pitch, and occasioning a temporary halt of play.

(b) In the event of a FREE BALL, playing resumes by the PLAYER nearest to the ball undertaking a COLLECTION.

21. Connection (a) This is a relocation of a POSER to establish control over a ball that came to rest beyond its range.

(b) It involves the lifting of the affected POSER and laying it over the erstwhile CLOSE ball.

(c) Thereafter, the DEFENDING TEAM is entitled to undertake one INDEPENDENT COVER (IC), while the ATTACKING TEAM may follow with one COUNTER-COVER.

(d) The ATTACKER'S shot shall not be taken until the DEFENDING TEAM has exercised or given up its right to the IC.

22. Marking

This is the instance of a COVER terminating in the RANGE of an opposing ATTACKER and obstructing a probable path of the latter's impending shot.

23. Scoring a Goal (a) A goal is scored if the ball crosses the goal line, between the posts, and does not get inside the basket of the goalie-boom.

(b) A ball that ends up in the basket of the goalie-boom has been saved and, therefore, is not a goal.

(c) The centre of the ball must cross the goal line for the goal to count.

(d) After a goal has been scored, play restarts with a kick-off by the team that conceded the goal.

Playing

24. Play Action (a) The game comprises a combination of operations made in alternate turns by the two competing teams.

(b) Playing proceeds in two halves of 45 minutes each. Both teams change table ends at the end of the first half.

(c) At the end of the full time of 90 minutes, the team that has scored the most goals is the winner.

(d) If the match is a draw at full time, the game may be continued on extra time, divided into two halves of 20 minutes each.

(e) The goals scored in extra time may be added to the scores at full-time to get the final score.

(f) If at the end of extra time the match is sill a draw, the teams may then play for another 20 minutes for a 'golden goal', i.e. the first team to score wins.

(g) If at the end of the golden goal period the event is still a draw, the winner may finally be decided by a penalty shoot-out.

25. Kick Off (a) Play starts with a kick off. The team to do the kick-off is decided by the toss of a coin. The winner of the toss decides which end of the table to play the starting game from. Thereafter the sides deploy their PLAYERS in any preferred formation on their halves of the pitch.

(b) The team kicking off may advance two of its PLAYERS in the centre circle. No other PLAYERS may be placed in the circle during the kick off.

(c) The kick off is taken by shooting the ball in any direction.

(d) When the ball is on a team's own half of the pitch, that team is said to be DEFENDING and the other ATTACKING.

26. Attacking (a) When one team is attacking, the other is defending. The DEFENDING TEAM may try to block the likely path of the ball with its own PLAYERS (COVER).

27. Play by Turns (a) During the course of play, sides alternate turns at the pitch, with a team's turn ending when it loses control of the ball, or fouls.

(b) When a turn ends free of a foul, the incoming player shall accepts the pitch in position.

Fouls

28. Shooting Foul

Shooting the ball other than with the cue tip.

29. Touching the Opposition (a) If, in undertaking COVER, the affected PLAYER touches either the ball or any of the opponent's PLAYERS, a foul has been committed.

(b) If in undertaking a SHOT the cue touches any of the opponent's PLAYERS, a foul has been committed.

30. Foot on Floor (a) A shot is a foul if a player does not have at least one foot in contact with the floor at the moment the cue tip makes contact with the ball.

(b) Foot attire must be normal in regard to size, shape and manner in which it is worn.

31. Shooting a Moving Ball

It is a foul if a PLAYER shoots while the ball is in motion. For the benefit of any doubt, a spinning ball is a ball in motion.

32. Incomplete Shot

A shot is not complete, and cannot to count, until the affected ball has become motionless.

33. Offsides:

(a) If, at the time the ball is shot forward, an ATTACKER is both past mid-field and there is only one opposition between him and the goal, then it is offsides.

(b) There are no offsides on a corner shoot or a throw-in.

(c) Offsides result in an indirect free shoot for the offended team (d)

34. Flick-in

If the ball crosses a sideline and leaves the field, a flick-in is awarded, against the team that last touched the ball, to the opponent.

35. Corner Shoots & Goal Shoots:

(a) A corner shoot or goal shoot is awarded when the ball crosses an end-line, i.e. leaves the field.

(b) If it was the offending team that shot the ball out, play is restarted with a goal shoot awarded to the DEFENDING TEAM.

(c) If it was the DEFENDING TEAM that shot the ball out, play is restarted with a corner shoot awarded to the offending team.

(d) The goal shoot is taken from anywhere inside the "goalie box". Any PLAYER, including the goalie-boom, can take it.

(e) The corner shoot is taken from the corner nearest to where the ball left the field.

(f) Any PLAYER in the team may take the corner or goal shot; the offended PLAYER need not take the shot.

36. Handball (a) Upon any incident of contact between the ball and arm of a PLAYER, the opponent will be awarded a direct shoot.

(b) Any PLAYER in the team may take the direct free shot; the offended PLAYER need not take the shot.

37. Touching Opposing Player

It is a fowl for a player to touch a PLAYER of the opposing team.

38. Indirect Free Shoots:

(a) An indirect shoot is awarded for offsides, when the goalie-boom knocks down an opponent, and when a directly shot ball knocks down an opponent.

(b) The defence must LOCATE at least 20 centimeters (or two PATCHES) away from the spot of the shoot.

(c) Any PLAYER in the team may take the indirect free shot; the offended team need not take the shot.

39. Direct Free Shoots (a) A direct free shoot is awarded to the opposite team for handball (ball touching the arm) or for any malicious act. The defence must LOCATE at least 20 centimeters (or two PATCHES) away from the spot of the shoot.

(b) On a direct kick you can score by kicking the ball directly into the goal.

(c) Direct shoot infractions committed inside the penalty area result in penalty shoots.

(d) Any PLAYER in the team may take the direct free shot; the offended team need not take the shot.

40. Penalty Shoots (a) The ball is located at the penalty spot and all PLAYERS except the shooter must clear the penalty area until the ball is shot.

(b) The goalie-boom must be still until the ball it shot. The shooter must wait for the referee's signal/indication that goalkeeper.

(c) Shots that ricochet back into pitch are live balls, and will, when it rests, revert to the nearest PLAYER to shoot it.

(d) The penalty shot may be taken by any PLAYER in the team; the offended team need not take the shot.

41. YELLOW CARDS (Caution or Warning Preceding Ejection):

These can be shown to a team for its repeated failure to comply with an official's instruction and to curtail any situation that might get out of hand.

42. RED CARDS (Ejection without replacement):

(a) When a red card is shown, the affected team shall withdraw any one of its PLAYERS from play.

(b) If a red card is shown and the affected team hesitates to freely withdraw one of its PLAYERS, the referee is obliged to nominate the PLAYER to be withdrawn and proceed to effect the ejection himself.

(c) Two yellow card offences automatically result in a red card ejection.

43. Goalie-Boom Rules:

(a) Goalie-boom may collect the ball only inside the penalty area. Outside this area it becomes a 'handball' and results in a direct free kick for the opposing team.

(b) Goalie-boom may be used to prod off a ball in motion, but it must not touch an opponent while doing this.

(c) If a goalie-boom touches an opponent outside the penalty area, a Yellow Card must be shown in consequence.

(d) If a goalie-boom touches or knocks down an opponent inside the penalty area, the consequence is a penalty shoot.

(e) If a goalie-boom touches its mate in the course of prodding the ball, there is no consequence. The mate should be left in its new position if it was displaced.

(f) If a goalie-boom knocks down its mate in the course of prodding that mate should be temporarily withdrawn from the pitch for five cycles of play, after which it may be returned and freely located anywhere on its team's own side of the pitch.

44. Foul from Touching the Ball (a) It is a foul to shoot, touch, or in any way make contact with the either the ball in play or any PLAYER, with anything (the body, clothing, chalk, mechanical bridge, cue shaft, etc.), except the cue tip (while attached to the cue shaft), which may contact the ball in the execution of a legal shot.

(b) Any object ball moved during a standard foul must be returned as closely as possible to its original position as judged by the referee.

45. Push Shot Foul

It is a foul if the ball is pushed by the cue tip, with contact being maintained for more than the momentary time commensurate with a shot. (Such shots are referred to as push shots.)

46. Player Responsibility Fouls

A player is responsible for chalk, bridges, files and any other items or equipment he brings to, uses at, or causes to approximate the pitch. If, for example, he drops a piece of chalk, or knocks off a mechanical bridge head. he is guilty of a foul should such an object make contact with the ball in play.

47. Ball Moving Spontaneously

If the ball shifts, settles, turns or otherwise moves "by itself," the ball shall remain in the position it assumed and play continues. A hanging ball that falls into the gutter "by itself" after being motionless for 5 seconds or longer shall be replaced as closely as possible to its position prior to falling, and play shall continue.

48. Non-Player Interference

If the ball is moved (or a PLAYER bumped such that play is directly affected) by a non-player during the match, the ball shall be replaced as near as possible to its original position immediately prior to the incident, and play shall resume with no penalty on the team affected. If the match is officiated, the referee shall replace the ball. This rule also applies to "act of God" interferences, such as earthquakes, hurricanes, light fixture falling, power failures, etc. If the ball cannot be restored to its original position, replay the game with the original PLAYER breaking.

49. Ball in Hand Foul

During ball in hand placement, the PLAYER may use his hand or any part of his cue (including the tip) to position the ball. When placing the ball in position, any forward shot motion of the cue stick contacting the ball will be considered a foul if it is not a legal shot.

50. Interference

If the non-shooting PLAYER distracts his opponent or interferes with the latter's play, he has fouled. If a PLAYER shoots out of turn, or moves the ball except during his turn, it is considered to be an interference.

51. Lifting and Placing the Ball

If a ball was lifted and is to be replaced, its position must be marked. If a ball is to be placed in any other position, it is recommended that the ball's original position be marked.

52. Devices

It is illegal to use a ball or any other measuring device to gauge if the ball would travel through a gap, etc. Only the cue stick may be used to aid the judging of gaps or the aligning of a shot, so long as the cue is held by the hand and does not touch the pitch or the pitch. To do so otherwise is a foul.

53. Illegal Marks on the Pitch

If a PLAYER intentionally marks the pitch in any way (including the placement of chalk) to assist in executing the shot, it is a foul.

The invention claimed is:

1. A tabletop game for playing a game comprising:

a plurality of playing figures, wherein each playing figure comprises a model player fitted to a hollow base that defines a cavity therein, wherein the base has at least one opening in communication with the cavity and the model player has at least one opening in communication with the cavity in the hollow base;

at least one ball dimensioned to enter the cavity within the base through the opening in the base or through the opening in the model player;

a playing surface having two sides and two ends; the two sides and two ends arranged generally in the shape of a rectangle;

a first goal positioned adjacent the first end of the playing surface and a second goal positioned adjacent the second end of the playing surface; and at least two cues configured and adapted for striking the ball and propelling the ball either across the playing surface or through the air.

2. A tabletop game according to claim 1, wherein the figure has three openings on the base.

3. A tabletop game according to claim 2, wherein the three openings are positioned at the left, right and front of the base respectively.

4. A tabletop game according to claim 1, wherein the figure has only one opening on the model player.

5. A tabletop game according to claim 4, wherein the model player has a chest and the opening on the model player is on the chest.

6. A tabletop game according to claim 1, wherein the figure has one opening on the model player and three openings on the base.

7. A tabletop game according to claim 1, comprising from two to twenty playing figures.

8. A tabletop game according to claim 1, comprising twenty playing figures.

9. A tabletop game according to claim 1, wherein the model player is releasably attachable to the base.

10. A tabletop game according to claim 1, additionally comprising studs for supporting the ball in an elevated position above the surface upon which the stud is positioned.

11. A tabletop game according to claim 1, wherein the first goal is releasably attachable to the first end of the playing surface and the second goal is releasably attachable to the second end of the playing surface.

12. A tabletop game according to claim 1, wherein the playing surface is at least partially surrounded by a trough.

13. A tabletop game according to claim 12, wherein the playing surface is completely surrounded by the trough.

14. A tabletop game according to claim 1, wherein the playing surface is demarcated into a number of squares.

15. A tabletop game according to claim 14, wherein the playing surface is demarcated into between two hundred and five hundred squares.

* * * * *